US006134400A

United States Patent [19]

Higashi et al.

[11] Patent Number: 6,134,400

[45] Date of Patent: Oct. 17, 2000

[54] TONER IMAGE FIXING APPARATUS HAVING STANDBY MODE TEMPERATURE CONTROL DEVICE

[75] Inventors: Yuichiro Higashi; Takeshi Kato, both of Tokyo, Japan

[73] Assignee: Nitto Kogyo Co., Ltd., Tokyo, Japan

[21] Appl. No.: 09/244,119

[22] Filed: Feb. 4, 1999

[30] Foreign Application Priority Data

Feb. 9, 1998 [JP] Japan ..... 10-040965

[51] Int. Cl.[7] ..... G03G 15/20

[52] U.S. Cl. ..... 399/70; 219/216; 399/328; 399/329; 432/60

[58] Field of Search ..... 399/67, 69, 70, 399/328, 329, 330, 331; 118/60; 219/216; 432/60

[56] References Cited

U.S. PATENT DOCUMENTS 3,811,828 5/1974 Ohta et al. ..... 219/216 X
4,582,416 4/1986 Karz et al. ..... 219/216 X
5,053,829 10/1991 Field et al. ..... 219/216 X
5,115,279 5/1992 Nishikawa et al. ..... 219/216 X

*Primary Examiner*—William J. Royer
*Attorney, Agent, or Firm*—Armstrong, Westerman, Hattori, McLeland and Naughton

[57] ABSTRACT

A toner image fixing apparatus has a fixing roller, a pressing roller normally urged toward the fixing roller for pressing a sheet with an unfixed toner image carried on a surface thereof against the fixing roller to fix the unfixed toner image to the sheet when the sheet passes in one direction through a rolling contact region between the fixing roller and the pressing roller, a heating roller disposed on one side of the fixing roller opposite to the pressing roller, the heating roller having a heating source disposed therein for heating the heating roller, an endless heat transfer belt trained around the heating roller and the fixing roller for transferring heat from the heating source to heat the unfixed toner image on the sheet when the sheet passes through the rolling contact region, and a standby mode temperature control circuit for maintaining temperatures of the fixing roller and the pressing roller in a predetermined temperature range in a standby mode.

10 Claims, 10 Drawing Sheets

TONER IMAGE FIXING APPARATUS HAVING STANDBY MODE TEMPERATURE CONTROL DEVICE

BACKGROUND OF THE INVENTION

1. Field of the Invention

The present invention relates to a toner image fixing apparatus for fusing and pressing a toner on a recording medium to fix the toner to the recording medium in an image forming system such as a copying machine, a printer, a facsimile machine, etc.

2. Description of the Related Art

One recent toner image fixing apparatus for use in electrophotographic machines is illustrated in FIG. 9 of the accompanying drawings. As shown in FIG. 9, the toner image fixing apparatus has a fixing roller R1, a heating and tensioning roller R3, an endless fixing belt B trained around the rollers R1, R3, and a pressing roller R2 disposed below and pressed against the fixing roller R1 with the fixing belt B interposed therebetween. When a recording medium D in the form of a sheet with an unfixed toner image carried thereon is fed into the toner image fixing apparatus by a sheet feeder, the recording medium D is reheated by the heating and tensioning roller R3, and then the toner image is fixed to the recording medium D by the fixing belt B in a nipping region between the rollers R1, R2. Since the recording medium D is preheated, the nipping region may be set to a relatively low temperature. The fixing belt B is of such a small heat capacity that when the recording medium D passes through the nipping region, the temperature of the fixing belt B is quickly lowered to increase the coherent ability of the toner which is separated from the fixing belt B at the outlet of the nipping region, for thereby allowing the toner to be easily separated from the fixing belt B. Even if the fixing belt B is free of oil or coated with a small amount of oil, a clear fixed toner image can be produced on the recording medium D without offsets. The toner image fixing apparatus shown in FIG. 9 is thus capable of solving the problems of toner separation and oil coating, which have not been eliminated by other toner image fixing apparatus using only a heating roller.

The conventional toner image fixing apparatus shown in FIG. 9 will be described in greater detail. The pressing roller R2 is positioned directly beneath the fixing roller R1, and the heating and tensioning roller R3 is disposed upstream of the fixing roller R1 with respect the direction in which the recording medium D is fed into the toner image fixing apparatus along the fixing belt B that is trained around the rollers R1, R3.

The toner image fixing apparatus also has an oil coating roller R4 disposed above an upper run of the fixing belt B. A guide plate G for supporting the recording medium D is disposed below a lower run of the fixing belt B, and a gap between the guide plate G and the lower run of the fixing belt B serves as a preheating passage P for preheating the recording medium D when the recording medium D travels below the heating and tensioning roller R3 toward the nipping region.

The fixing belt B is tensioned to a desired tension level when the heating and tensioning roller R3 is pushed away from the fixing roller R1 by a pressing lever U. The fixing belt B is actuated by the fixing roller R1 which is coupled to an actuator. Since the fixing belt B is appropriately tensioned, it can stably rotate around the rollers R1, R3 without undesirable slippage and sagging.

A heater H is housed in the heating and tensioning roller R3. The heating and tensioning roller R3 is associated with a thermistor S for measuring the temperature of the surface of a core of the heating and tensioning roller R3.

During the fixing process, based on a signal from the thermistor S, a controller (not shown) connected to the thermistor S controls the amount of heat generated by the heating and tensioning roller R3 so that the temperature of the surface of the core of the heating and tensioning roller R3 will be kept at a preset level.

The temperature of the fixing belt B on the fixing roller R1 varies depending on the period of time in which the fixing belt B has rotated, and is not constant when the recording medium D passes through the nipping region. If the period of time in which the fixing belt B has rotated is short, then the temperature of the fixing belt B on the fixing roller R1 is low. In order to increase the temperature of the fixing belt B on the fixing roller R1, it is necessary to increase a temperature setting for the heating and tensioning roller R3 for thereby bringing the temperature of the fixing belt B on the fixing roller R1 into a fixing temperature range at all times.

If the toner image fixing apparatus shown in FIG. 9 is used to produce successive full-color copies, since the period of time in which the fixing belt B has rotated increases, the temperature of the fixing belt B on the fixing roller R1 also increases, and so does the temperature of the outlet of the nipping region. FIG. 10 of the accompanying drawings shows temperature characteristics of the toner image fixing apparatus shown in FIG. 9.

In FIG. 10, the horizontal axis represents the period of time in which the fixing belt B has rotated, and the vertical axis represents the temperature of the fixing belt B on the rollers R1, R3. First, a temperature characteristic of the toner image fixing apparatus at the time the amount of heat radiated by the heater H is controlled in order to equalize the temperature of the fixing belt B on the heating and tensioning roller R3 to a preset temperature T2 will be described below. A solid-line wavy curve W1 represents the temperature of the fixing belt B on the heating and tensioning roller R3, and a solid-line curve C1 represents the temperature of the fixing belt B on the fixing roller R1.

After a standby period, as the period of time in which the fixing belt B has rotated increases, the temperature of the fixing belt B on the fixing roller R1 increases. When the temperature of the fixing belt B on the fixing roller R1 exceeds an upper limit temperature T1 of a toner image fixing temperature range, the possibility of hot sheet offsets, i.e., sheet offsets at high temperatures, or sheet jams increases. When the temperature of the fixing belt B on the fixing roller R1 becomes lower than a lower limit temperature T1' of the toner image fixing temperature range, the possibility of cold sheet offsets, i.e., sheet offsets at low temperatures, or unfixed toner regions increases. Therefore, the temperature of the fixing belt B on the fixing roller R1 should be kept in the toner image fixing temperature range which lies between the upper limit temperature T1 and the lower limit temperature T1'.

The tendency described above increases as the linear velocity of the fixing belt B increases, as can be understood from Table 1 shown below.

TABLE 1

| | Linear velocity (mm/sec.) | | | | | |
|---|---|---|---|---|---|---|
| | 80 | | | 120 | | |
| Idling time (sec.) | 30 | 60 | 120 | 30 | 60 | 120 |
| Belt temp. on heating roller (° C.) | 150 | 150 | 150 | 150 | 150 | 150 |
| Belt temp. on fixing roller (° C.) | 130 | 138 | 142 | 132 | 146 | 148 |
| Occurrence of jams or offsets | Yes | No | Yes | No | Yes | NO |

Table 1 gives the results of a test which was conducted to measure the temperatures of the fixing belt B on the heating and tensioning roller R3 and the fixing roller R1 after the fixing belt B rotated for given idling times at different linear velocities, and also to check if jams or offsets occurred.

The test used a fixing belt comprising a polyimide layer having a thickness of 100 $\mu$m and a silicone rubber layer having a thickness of 100 $\mu$m, a fixing roller made of silicone sponge having a hardness of 30 HS and a thickness of 4 mm, and a pressing roller made of silicone sponge having a hardness of 40 HS and a thickness of 4 mm. The heating and tensioning roller was heated to 150° C., and the recording medium was sheets of paper having a weight of 45 kg per 1,000 sheets, A4 size (52.3 g/m$^2$) and subjected to a pressure of 14.6 kg on one side by a pressing roller. The sheets of paper were coated with toner fully over their entire surface with no toner-free region at their leading edge.

As can be seen from Table 1, when the linear velocity of the fixing belt B increased from 80 mm/sec. to 120 mm/sec. the temperature of the fixing belt B on the fixing roller R1 rises more quickly beyond the upper limit temperature T1 of the toner image fixing temperature range, resulting in a greater possibility of sheet offsets or sheet jams.

The above drawback, i.e., sheet offsets and sheet jams, can be avoided when the temperature of the fixing belt B on the heating and tensioning roller R3 is set to a temperature T2', lower than the preset temperature T2, such that the temperature of the fixing belt B on the fixing roller R1 will be equal to or below the upper limit temperature T1 at its maximum, as indicated by broken-line characteristics curves W2, C2. However, it will take a longer period of time for the temperature of the fixing belt B on the fixing roller R1 to reach the lower limit temperature T1' of the toner image fixing temperature range, with the result that a fixation readiness time, i.e., a period of time required for the toner image fixing apparatus to become ready for fixing toner images, increases from TS to TS'.

After the toner image on the recording medium D is fixed, the sheet feeder for feeding the recording medium D into the toner image fixing apparatus is deactivated, the operation of the fixing belt B is stopped, and the heater H is de-energized, whereupon the toner image fixing apparatus enters a standby mode. Once the toner image fixing apparatus enters the standby mode, the surface temperatures of the fixing belt B and the fixing roller R1 fall gradually. If the standby mode continues for a long period of time, then the fixing belt B and the fixing roller R1 become so cold that when a fixing process is started again, it will take a long period of time before the fixing roller R1 is heated to the toner image fixing temperature range. As a result, the operator has to wait a long period of time before the toner image fixing apparatus is operational again.

SUMMARY OF THE INVENTION

It is a major object of the present invention to provide a toner image fixing apparatus which is effective to prevent sheet offsets and sheet jams, fix unfixed toner images securely to recording mediums, and shorten a fixation readiness time from the end of a standby mode even when the standby mode has continued for a long period of time, so that the operator does not need to wait long before a fixing process begins.

In order to attain the above-mentioned object, there is provided a toner image fixing apparatus according to a first aspect of the present invention, which comprises a fixing roller, a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, said heating roller having heating means disposed therein for heating said heating roller, an endless heat transfer belt trained around said heating roller and said fixing roller for transferring heat from said heating means to heat the unfixed toner image on said sheet when said sheet passes through said rolling contact region, and standby mode temperature control means for maintaining temperatures of said fixing roller and said pressing roller in a predetermined temperature range in a standby mode.

According to a second aspect of the present invention, there is provided a toner image fixing apparatus which further comprises actuating means for rotating at least said pressing roller, and heating control means for controlling said heating means.

According to a third aspect of the present invention, there is provided a toner image fixing apparatus which further comprises detecting means for detecting the temperature of said pressing roller, said standby mode temperature control means comprising means for controlling said heating control means to energize said heating means and also controlling said actuating means to rotate said pressing roller to rotate said endless heat transfer belt for thereby heating said fixing roller and said pressing roller held in rolling contact therewith, if the temperature of said pressing roller is determined as being lower than said predetermined temperature range based on the temperature of said pressing roller detected by said detecting means.

According to a fourth aspect of the present invention, there is provided a toner image fixing apparatus wherein said standby mode temperature control means comprises means for controlling said heating control means to de-energize said heating means and also controlling said actuating means to stop said pressing roller a predetermined period of time after said heating means is de-energized, if the temperature of said pressing roller is determined as being higher than said predetermined temperature range based on the temperature of said pressing roller detected by said detecting means.

According to a fifth aspect of the present invention, there is provided a toner image fixing apparatus wherein said standby mode temperature control means comprises means for stopping controlling said heating control means and said actuating means when said standby mode is canceled.

According to a sixth aspect of the present invention, there is provided a toner image fixing apparatus which further comprises counting means for measuring a period of time that has elapsed from the start of the standby mode, said standby mode temperature control means comprising means for controlling said heating control means to energize said heating means and also controlling said actuating means to rotate said pressing roller at a first time interval measured by said counting means from the start of the standby mode, for thereby heating said fixing belt and said pressing roller held in rolling contact therewith.

According to a seventh aspect of the present invention, there is provided a toner image fixing apparatus wherein said standby mode temperature control means comprises means for controlling said heating control means to energize said heating means for a second time interval and further controlling said actuating means to rotate said pressing roller for a third time interval.

According to an eighth aspect of the present invention, there is provided a toner image fixing apparatus wherein said third time interval is longer than said second time interval.

According to a ninth aspect of the present invention, there is provided a toner image fixing apparatus wherein said standby mode temperature control means comprises means for stopping controlling said heating control means and said actuating means when said standby mode is canceled.

According to a tenth aspect of the present invention, there is provided a toner image fixing apparatus wherein said predetermined temperature range is lower than a temperature at which the unfixed toner image is fixed to said sheet.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

General structure of toner image fixing apparatus 10

Figure 1:
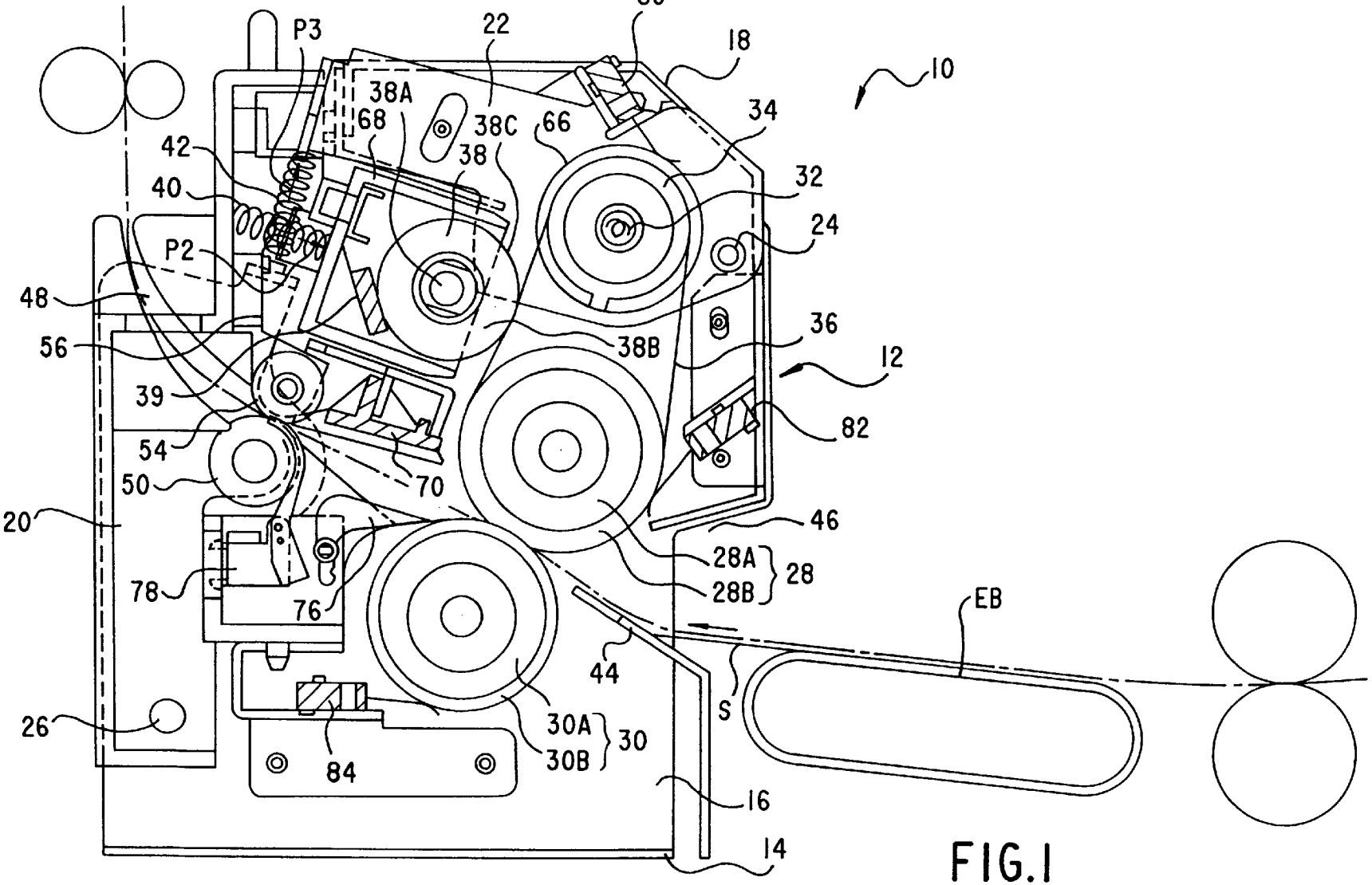
FIG. 1 is a sectional front elevational view of a toner image fixing apparatus according to an embodiment of the present invention.

As shown in FIG. 1, a toner image fixing apparatus 10 according to an embodiment of the present invention has a housing 12 to be fixed to a frame of an electronic image forming system (not shown) such as an electrophotographic copying system, for example. The housing 12 comprises a base plate 14 to be fixed directly to the frame, a pair of vertical side plates 16 erected from respective side edges of the base plate 14, an upper cover 18 mounted on the side plates 16 to cover upper right regions of the side plates 16, and a left cover 20 mounted on the side plates 16 to cover left side regions of the side plates 16.

The upper cover 18 is fixedly mounted on the side plates 16. A swing lever 22 is swingably supported on right portions of the side plates 16 by a first pivot shaft 24 positioned on a right end of the swing lever 22, for swinging movement about the first pivot shaft 24 to provide an open space at a left end of the swing lever 22. The left cover 20 is swingably supported on the side plates 16 by a second pivot shaft 26 positioned on a lower end of the left cover 20, for swinging movement about the second pivot shaft 26 to provide an open space at an upper end of the left cover 20.

The toner image fixing apparatus 10 has a fixing roller 28 assembly including a fixing roller 28 rotatably supported on the side plates 16 for rotation about a fixed axis, a pressing roller 30 positioned obliquely downwardly of the fixing roller 28 in rolling contact with the fixing roller 28 and rotatably supported on the side plates 16 for rotation about a fixed axis parallel to the fixed axis of the fixing roller 28, and a heating roller 34 positioned obliquely upwardly of the fixing roller 28 and rotatably supported on the swing lever 22 for rotation about its own axis. The heating roller 34 has a heater 32 such as a halogen lamp or the like disposed therein. An endless fixing belt (heat transfer belt) 36 is trained around the fixing roller 28 and the heating roller 34.

Figure 2:
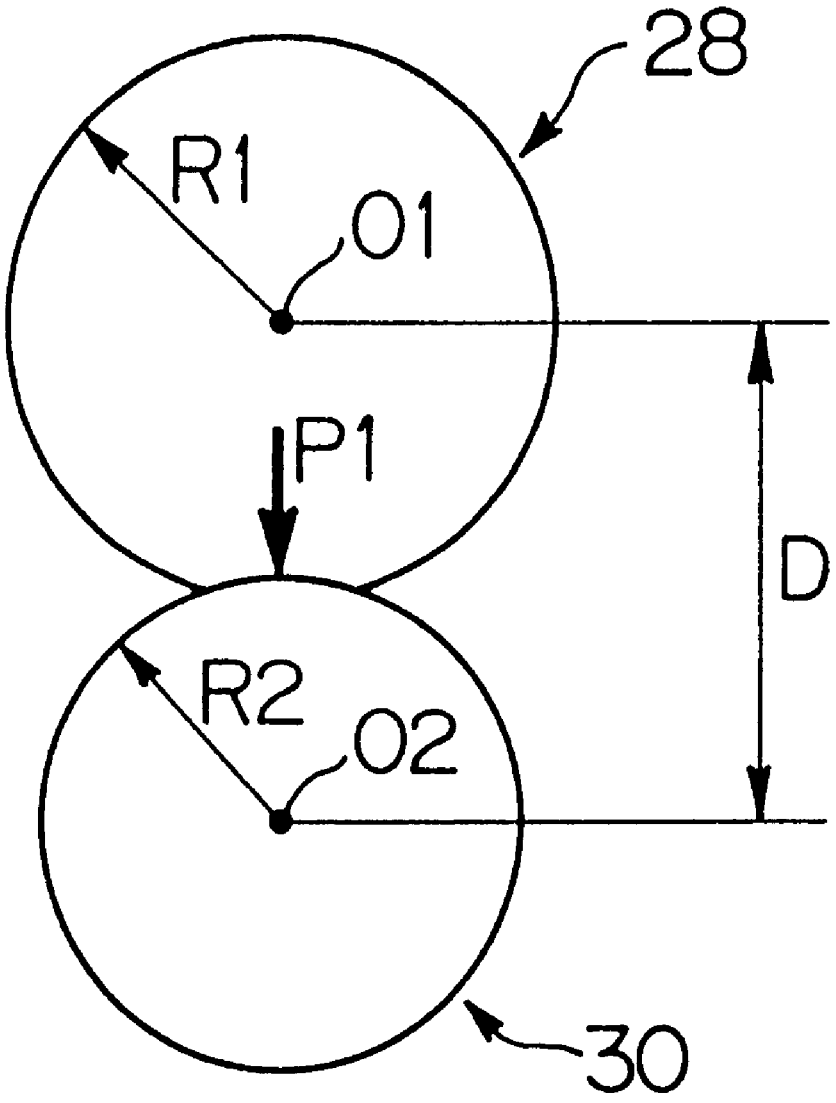
FIG. 2 is a schematic view showing the manner in which a fixing roller and a pressing roller are held in rolling contact with each other.

The fixing roller 28 comprises a resilient roller, and the pressing roller 30 comprises a roller harder than the fixing roller 28. As shown in FIG. 2, the fixing roller 28 and the pressing roller 30 have respective centers O1, O2 spaced from each other by a distance D which is slightly smaller than the sum (R1+R2) of their radii R1, R2. In a rolling contact region (nipping region) between the fixing roller 28 and the pressing roller 30, the fixing roller 28 and the pressing roller 30 are held in rolling contact with each other under a predetermined pressure P1, so that the fixing roller 28 has an outer circumferential surface made partly concave by the pressing roller 30 held in rolling contact therewith, thus providing a sufficient nipping width in a direction across the axes of the fixing roller 28 and the pressing roller 30.

The toner image fixing apparatus 10 also has an oil applying roller 38 for applying silicone oil to an outer circumferential surface of the fixing belt 36 and cleaning the outer surface of the fixing belt 36, a first helical spring 40 for normally pressing the oil applying roller 38 against the fixing belt 36 perpendicularly thereto to tension the fixing belt 36, and a second helical spring 42 for normally urging the heating roller 34 in a direction away from the fixing roller 28 to tension the fixing belt 36 in coaction with the first helical spring 40.

The upper cover 18 has a right lower portion bent inwardly into the housing 12. A guide plate 44 is positioned below and largely spaced from the bent right lower portion of the upper cover 18. The guide plate 44 and the bent right lower portion of the upper cover 18 jointly define an inlet port 46 therebetween for introducing therethrough a sheet S with an unfixed toner image carried thereon (hereinafter referred to as an "unfixed toner sheet") into the housing 12 in the direction (feed direction) indicated by the arrow in FIG. 1.

The guide plate 44 is inclined obliquely upwardly to the left such that the height of the guide plate 44 progressively increases into the housing 12. The guide plate 44 has an inlet end, i.e., a right end, positioned in confronting relation to an outlet end of a sheet feeding endless belt EB that is positioned in the electrophotographic copying system adjacent to the right end of the inlet port 46. The guide plate 44 has an outlet end, i.e., a left end, positioned in confronting relation to the rolling contact region (nipping region) between the fixing roller 28 and the pressing roller 30.

When the unfixed toner sheet S is fed in the feed direction indicated by the arrow toward the toner image fixing apparatus 10 by the endless belt EB, the leading end of the unfixed toner sheet S contacts the guide plate 44, and is then guided thereby to travel obliquely upwardly into the rolling contact region between the fixing roller 28 and the pressing roller 30.

A sheet discharge passage 48 is defined above the left cover 20 for discharging a sheet with a toner image fixed thereto with heat and pressure by the fixing roller 28 and the pressing roller 30 in the rolling contact region. Such a sheet will hereinafter be referred to as a "fixed toner sheet"). The sheet discharge passage 48 is oriented such that it discharges the fixed toner sheet substantially upwardly along a vertical plane.

A lower discharge roller 50 is rotatably mounted on the left cover 20 between the sheet discharge passage 48 and the rolling contact region. The lower discharge roller 50 is actuated by an actuating mechanism 52 (described later on) to rotate at a speed greater than the pressing roller 30, i.e., at a speed which is 5% greater than the speed at which the pressing roller 30 rotates. An upper discharge roller 54 is positioned obliquely upwardly of the lower discharge roller 50 and held in rolling contact with the lower discharge roller 50 under resilient forces from a leaf spring 56. The upper discharge roller 54 is positioned with respect to the lower discharge roller 50 such that a line interconnecting the centers of the upper and lower discharge rollers 54, 50 extends substantially perpendicularly across a sheet discharge passage along which the fixed toner sheet is delivered from the rolling contact region to the sheet discharge passage 48.

In the toner image fixing apparatus 10 thus constructed, the unfixed toner sheet S fed onto the guide plate 44 by the endless belt EB has its lower surface, opposite to the unfixed toner image, borne by the guide plate 44, and is guided by the guide plate 44 toward the rolling contact region (nipping region) between the fixing roller 28 and the pressing roller 30, with the fixing belt 36 being trained around the fixing roller 28. When the unfixed toner sheet S passes under pressure between the fixing roller 28 and the pressing roller 30, the unfixed toner image is fixed to the sheet S with heat and pressure.

Fixing roller 28

The fixing roller 28 comprises a core 28A rotatably supported on the side plates 16 by bearings (not shown) and a roller sleeve 28B fitted coaxially over the core 28A. The fixing belt 36 is trained around the roller sleeve 28B. The fixing roller 28 has an outside diameter of 38.5 mm in this embodiment. The core 28A comprises a shaft of iron having a diameter of 25 mm, and the roller sleeve 28B is made of a heat-resistant resilient material of silicone rubber having a wall thickness of 6.75 mm. Specifically, the roller sleeve 28B is made of silicone rubber sponge having an Asker Model C hardness of 35.

Figure 3:
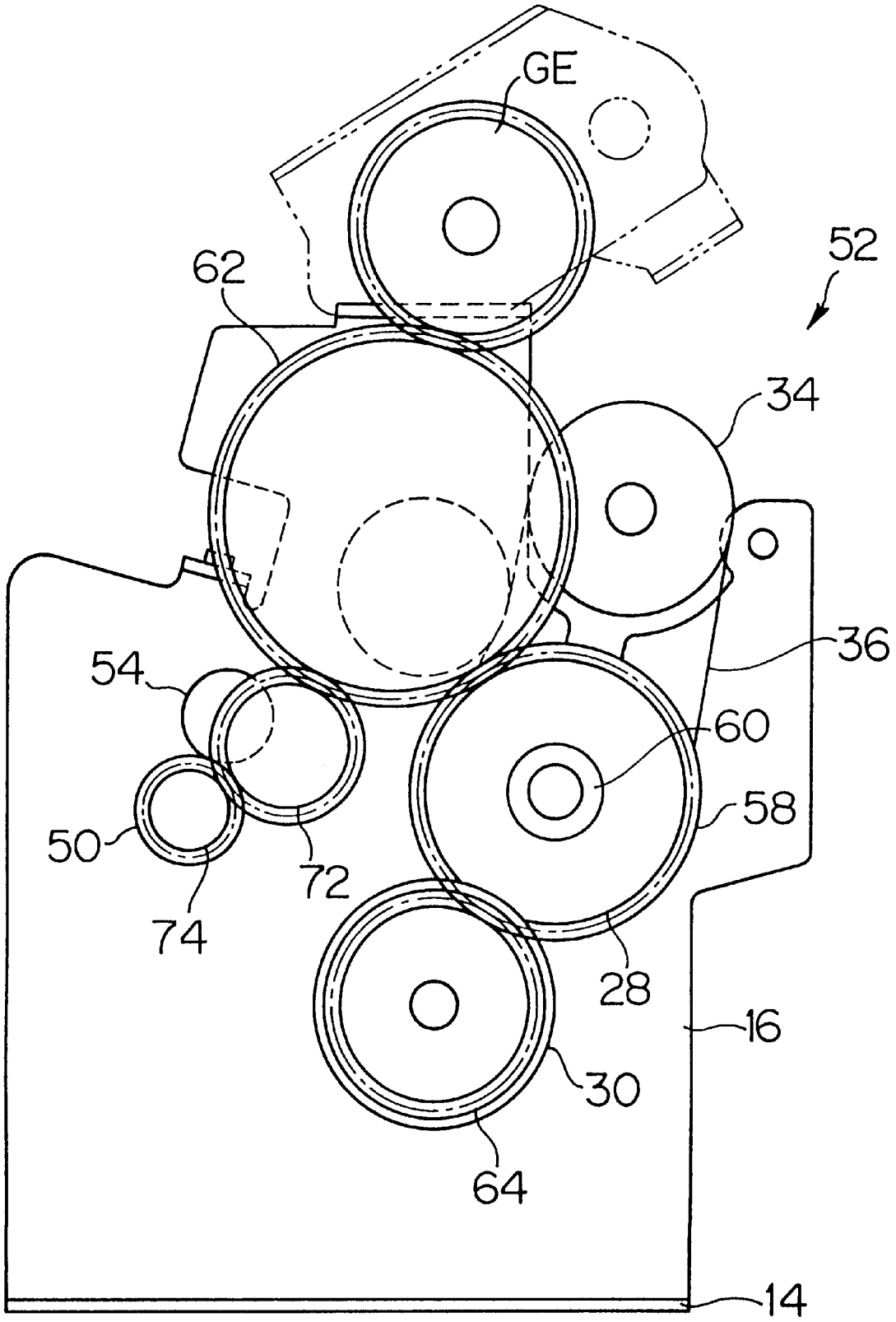
FIG. 3 is a schematic front elevational view of an actuating mechanism of the toner image fixing apparatus shown in FIG. 1.

As shown in FIG. 3, the core 28A has an end combined with a shaft which is coaxially coupled to a first driven gear 58 through a one-way clutch 60 (described later on). The first driven gear 58 is held in mesh with a transmission gear 62 of the actuating mechanism 52. Drive forces produced by the actuating mechanism 52 are transmitted through the transmission gear 62 to the first driven gear 58 which is rotated clockwise to rotate the fixing roller 28 through the one-way clutch 60.

Pressing roller 30

As shown in FIG. 1, the pressing roller 30 comprises a core 30A rotatably supported on the side plates 16 by bearings (not shown) and a roller sleeve 30B fitted coaxially over the core 30A. The pressing roller 30 has an outside diameter of 35 mm in this embodiment. The core 30A comprises a shaft of iron having a diameter of 32 mm, and the roller sleeve 30B is made of a heat-resistant resilient material of silicone rubber having a wall thickness of 1.5 mm. Specifically, the roller sleeve 30B is made of silicone rubber sponge having a JIS Model A hardness of 20, which is harder than the roller sleeve 28B. The outer circumferential surface of the roller sleeve 30B is covered with a tube of fluoroplastics having a wall thickness of 50 $\mu$m.

As shown in FIG. 3, the core 30A has an end combined with a shaft which is coaxially coupled to a second driven gear 64 which is held in mesh with the first driven gear 58. Drive forces are transmitted from the first driven gear 58 to the second driven gear 64, which rotates the pressing roller 30 counterclockwise.

In this embodiment, the pressing roller 30 is used as a primary drive roller for establishing a speed at which the unfixed toner sheet is fed through the nipping region. The ratio of gear teeth of the first and second drive gears 58, 64 is selected such that the peripheral speed of the fixing roller 28 as it is thermally expanded is not greater than the peripheral speed of the pressing roller 30. Specifically, the speed at which the fixing roller 28 is rotated by the first driven gear 58 is slightly lower than the speed at which it is rotated in frictional engagement with the pressing roller 30 through the fixing belt 36.

The pressing roller 30 is not positioned directly downwardly of the fixing roller 28, but is displaced downstream in the feed direction of a position directly downward of the fixing roller 28. Specifically, the pressing roller 30 is positioned with respect to the fixing roller 28 such that an acute angle is formed between a vertical line passing through the center of the fixing roller 28 and a line segment passing through the centers of the fixing roller 28 and the pressing roller 30. The line segment passing through the centers of the fixing roller 28 and the pressing roller 30 extends perpendicularly to the feed direction across the rolling contact region.

One-way clutch 60

The one-way clutch 60 allows the fixing roller 28 to rotate clockwise relatively to the first driven gear 58, but prevents the fixing roller 28 from rotating counterclockwise relatively to the first driven gear 58, i.e., rotates the fixing roller 28 and the first driven gear 58 in unison with each other. Specifically, when the fixing roller 28 is cold, i.e., when the fixing roller 28 and the fixing belt 36 are driven by the pressing roller 30 while the fixing belt 36 is held in frictional engagement with the pressing roller 30 and the fixing roller 28 is held in frictional engagement with the fixing belt 36, the peripheral speed of the fixing roller 28 upon clockwise rotation thereof is the same as the peripheral speed of the pressing roller 30, and hence is slightly higher than the peripheral speed of the first driven gear 58. The difference between the peripheral speeds of the fixing roller 28 and the first driven gear 58 is absorbed by the one-way clutch 60.

When the heating roller 34 is heated by the heater 32 and the fixing roller 28 is heated through the fixing belt 36, the outside diameter of the fixing roller 28 is increased as it is thermally expanded, and the peripheral speed of the fixing roller 28 increases. Since the peripheral speed of the fixing roller 28 does not become higher than the peripheral speed of the pressing roller 30, the increase in the peripheral speed of the fixing roller 28 is absorbed by the one-way clutch 60.

The one-way clutch 60 offers the following advantages: If the one-way clutch 60 were not employed, when a sheet with a glossy and slippery surface, such as a coated sheet, is fed as an unfixed toner sheet into the rolling contact region, the fixing belt 36 would slip against the unfixed toner sheet, and drive forces would not be transmitted from the pressing roller 30 to the fixing belt 36 and the fixing roller 28, which would not then be driven by the pressing roller 30. Therefore, the unfixed toner sheet would be jammed in the rolling contact region, or even if the unfixed toner sheet passed through the rolling contact region, the unfixed toner image on the unfixed toner sheet would be abraded and disturbed by the fixing belt 36 kept at rest.

In this embodiment, however, since the one-way clutch 60 is connected between the fixing roller 28 and the first driven gear 58, even if drive forces from the pressing roller 30 are not transmitted to the fixing belt 36, the fixing roller 28 is rotated clockwise by the first driven gear 58 through the one-way clutch 60 when the peripheral speed of the fixing roller 28 starts being lower than the peripheral speed of the first driven gear 58. Therefore, the unfixed toner sheet passes reliably through the rolling contact region for effective protection against a sheet jam in the nipping region and toner image disturbance on the sheet.

Heating roller 34

In this embodiment, the heater in the heating roller 34 comprises a 800W halogen lamp which is designed to emit light at an intensity that is 50% greater in opposite end regions than in a central region thereof. The heating roller 34 comprises a core in the form of an aluminum pipe having a diameter of 30 mm and a wall thickness of 3.5 mm. The core is coated with a polytetrafluoroethylene (PTFE) layer having a thickness of 20 $\mu$m. A circular collar 66 made of heat-resistant polyetheretherketone (PEEK) and having a diameter of 30 mm is press-fitted over each of opposite bearing ends of the core for preventing the fixing belt 36 from being tortured or displaced out of position.

Fixing belt 36

The fixing belt 36 preferably has a heat capacity of 0.002 cal/°C.–0.025 cal/°C. per $cm^2$ so as to be able to preheat the unfixed toner on the unfixed toner sheet S to a fixing temperature through heat radiation for thereby fixing the toner without applying excessive heat. In this embodiment, the fixing belt 36 comprises an endless belt base of polyimide having a thickness of 100 $\mu$m and a heat-resistant resilient separating layer of silicone rubber that is coated to a thickness of 150 $\mu$m on an outer circumferential surface of the endless belt base of polyimide.

Alternatively, the fixing belt 36 may comprise an endless belt base of electroformed nickel having a thickness of 40 $\mu$m and a heat-resistant resilient separating layer of silicone rubber that is coated to a thickness of 150 $\mu$m on an outer circumferential surface of the endless belt base of electroformed nickel.

Oil applying roller 38

The oil applying roller 38 serves to apply a small amount of silicone oil to the outer circumferential surface of the fixing belt 36 for separating the sheet S easily from the fixing belt 36. The oil applying roller 38 comprises a support shaft 38A rotatably supported in a casing 68 for rotation about a fixed axis and a heat-resistant layer 38B of paper fitted over the support shaft 38A and impregnated with silicone coil. In this embodiment, the support shaft 38A comprises a shaft of iron having a diameter of 8 mm, and the heat-resistant layer 38B of paper is covered with a film 38C of porous fluoroplastics having a thickness of 100 $\mu$m. The oil applying roller 38 has a diameter of 22 mm. The oil applying roller 38 thus constructed is capable of stably applying a small amount of silicone oil to the outer circumferential surface of the fixing belt 36.

The outer circumferential surface of the oil applying roller 38 is smeared with dirt such as toner particles that are transferred from the outer circumferential surface of the fixing belt 36. A cleaning brush 39 is held in sliding contact with the outer circumferential surface of the oil applying roller 38 for removing such dirt off the outer circumferential surface of the oil applying roller 38 thereby to clean the oil applying roller 38.

Tensioning mechanism for the fixing belt 36

As described above, a mechanism for tensioning the fixing belt 36 has the first helical spring 40 for normally pressing the oil applying roller 38 against the fixing belt 36 perpendicularly thereto to tension the fixing belt 36, and the second helical spring 42 for normally urging the heating roller 34 in a direction away from the fixing roller 28 to tension the fixing belt 36 in coaction with the first helical spring 40.

The first helical spring 40 is attached to the left cover 20 for normally urging the casing 68, on which the oil applying roller 38 is rotatably supported, toward the fixing belt 36. The casing 68 is movably supported by a guide ring 70 on one of the side plates 16 for movement toward and away from the fixing belt 36. When the left cover 20 is swung open to the left about the second pivot shaft 26, the first helical spring 40 is disengaged from the casing 68, releasing the oil applying roller 38 from the fixing belt 36. When the left cover 20 is swung to the right about the second pivot shaft 26, the first helical spring 40 pushes the casing 68 under a pressing force P2, causing the oil applying roller 38 to press the fixing belt 36 under a certain tension.

The second helical spring 42 is connected between the left end of the swing lever 22 and the side plate 16 for normally urging the swing lever 22 to turn clockwise about the first pivot shaft 24, i.e., to push the heating roller 34 on the swing lever 22 under a pressing force P3 in a direction away from the fixing roller 28. In this manner, the fixing belt 36 is given a desired tension.

Therefore, the heating roller 34 is displaced away from the fixing roller 28 by the swing lever 22 under the bias of the second helical spring 42, tensioning the fixing belt 36 trained around the heating roller 34 and the fixing roller 28.

The fixing belt 36 thus tensioned by the first and second helical springs 40, 42 is held in frictional engagement with the pressing roller 30 and driven thereby. When the fixing belt 36 is driven by the pressing roller 30, the fixing roller 28 is stably driven thereby without slipping or sagging with respect to the fixing belt 36.

Actuating mechanism 52

As shown in FIG. 3, the transmission gear 62 is held in mesh with an output gear GE that is connected through a gear train (not shown) to an actuator in the electrophotographic copying system when the toner image fixing apparatus 10 is installed in the electrophotographic copying system. The transmission gear 62 can be driven to rotate by the output gear GE. The actuating mechanism 52 also has, in addition to the transmission gear 62, the first driven gear 58 held in mesh with the transmission gear 62 and coupled to the fixing roller 28 through the one-way clutch 60, and the second driven gear 64 held in mesh with the first driven gear 58 and fixed coaxially to the pressing roller 30.

The actuating mechanism 52 also has an idler gear 72 held in mesh with the transmission gear 62. The idler gear 72 is also held in mesh with a third driven gear 74 fixed coaxially to the lower discharge roller 50 for rotating the lower discharge roller 50 at a speed equal to or higher than the rotational speed of the pressing roller 30.

Other structural details

As shown in FIG. 1, the toner image fixing apparatus 10 has a peeler blade 76 for peeling the fixed toner sheet off the outer circumferential surface of the pressing roller 30, and a sheet sensor 78 for detecting the leading end of the fixed toner sheet as it is fed to a rolling contact region between the upper and lower discharge rollers 54, 50.

Figure 4:
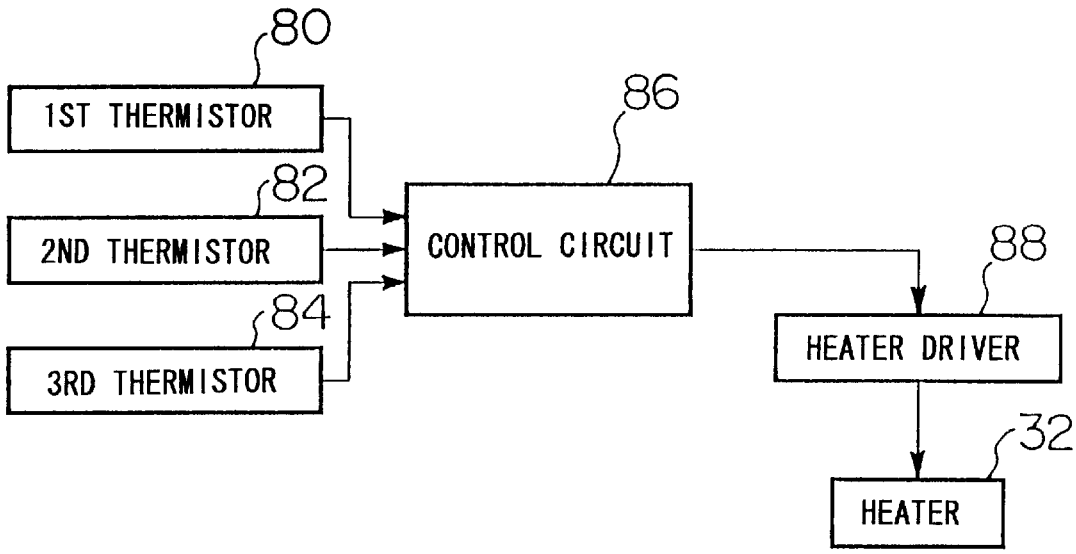
FIG. 4 is a block diagram of a control system for controlling a heat source in the toner image fixing apparatus shown in FIG. 1.

As shown in FIGS. 1 and 4, the toner image fixing apparatus 10 further includes a first thermistor 80 for detecting the temperature of the fixing belt 36 trained around the heating roller 34, a second thermistor 82 for detecting the temperature of the outer circumferential surface of the fixing belt 36 trained around the fixing roller 38, a third thermistor 84 for detecting the temperature of the outer circumferential surface of the pressing roller 84, and a control circuit 86 for controlling the heater 32 based on the temperatures detected by the first, second, and third thermistors 80, 82, 84. The control circuit 86 controls the heater 32 through a heater driver 88.

Position of the heating roller 34

The heating roller 34 is positioned substantially upwardly of the fixing roller 28. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Because the heating roller 34 is positioned substantially upwardly of the fixing roller 28, the unfixed toner sheet S carried on the upper surface of the guide plate 44 is reliably prevented from contacting the fixing belt 36 irrespective of how the unfixed toner sheet being fed may be curled. Consequently, the unfixed toner sheet S can be led to the rolling contact region between the fixing roller 28 and the pressing roller 30 without disturbing the unfixed toner image on the unfixed toner sheet S, so that the unfixed toner image on the unfixed toner sheet S can reliably be fixed to the unfixed toner sheet S in the rolling contact region.

Angle of the heating roller 34

Figure 5:
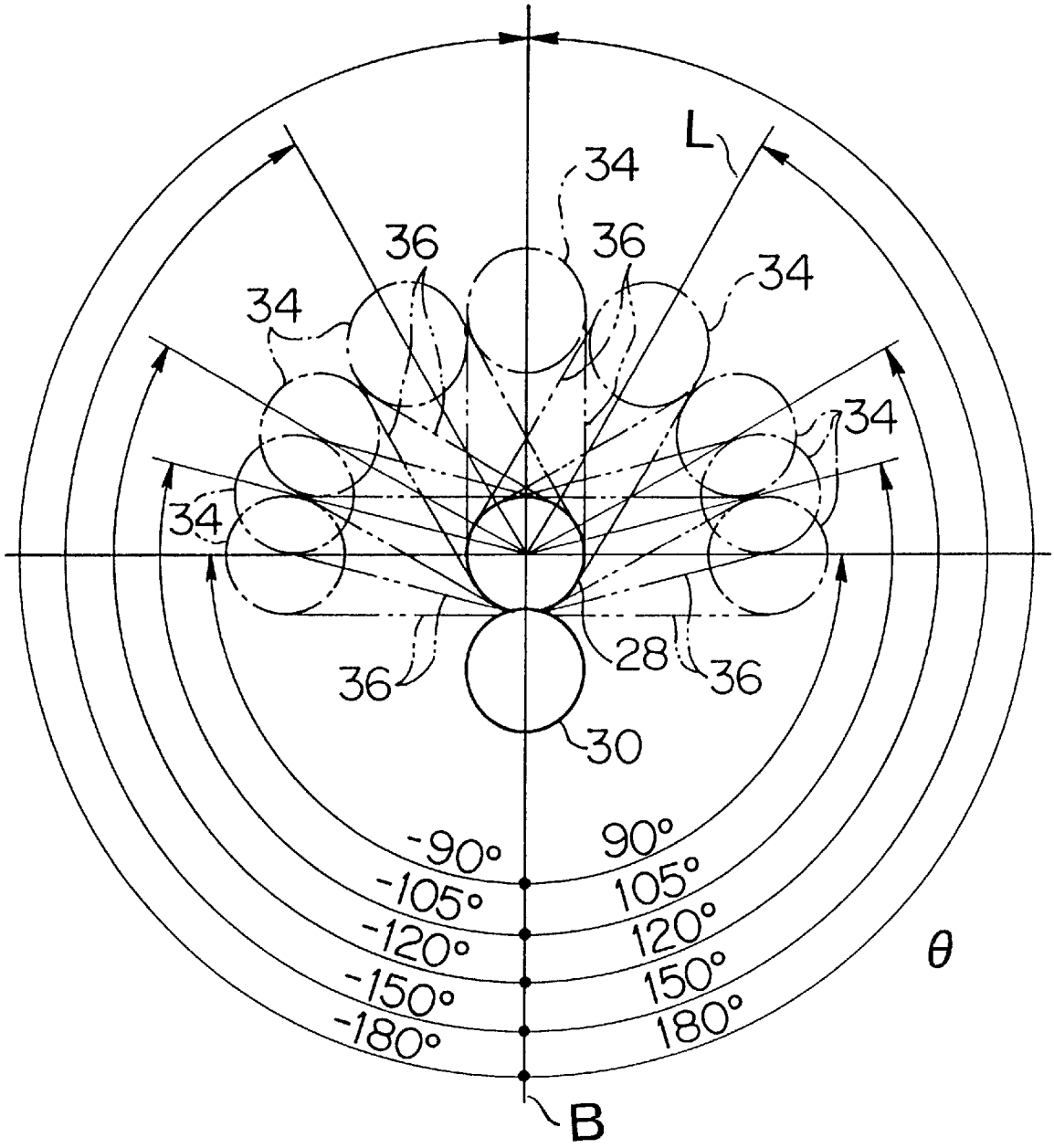
FIG. 5 is a diagram showing angles employed in an experiment conducted to check an allowable range of positions of a heating roller with respect to the fixing roller.

The fact that the heating roller 34 is positioned substantially upwardly of the fixing roller 28 offers advantages inherent in the toner image fixing apparatus 10. An experiment to determine an optimum angular range in which the heating roller 34 can be positioned substantially upwardly of the fixing roller 28 by changing the angle of the heating roller 34 as shown in FIG. 5 will be described below.

In the experiment, a straight line passing through the centers of the fixing roller 28 and the pressing roller 30 was defined as a reference line B, and an angle θ was defined between the reference line B and a line segment L interconnecting the centers of the fixing roller 28 and the heating roller 34. The angular position of the heating roller 34 with respect to the fixing roller 28 was changed to change the angle θ between 90° and 180°, and the frequency of rubbed states of toner images at the inlet of the rolling contact region between the fixing roller 28 and the pressing roller 30 and also the frequency of defects of toner images at the outlet of the rolling contact region between the fixing roller 28 and the pressing roller 30 were measured when the toner images were copied on one side and both sides of sheets.

The angle e was defined as a positive angle when measured counterclockwise from the reference line B, and as a negative angle when measured clockwise from the reference line B. Therefore, the heating roller 34 positioned at the angle θ=+180° and the heating roller 34 positioned at the angle θ=−180° were in the same angular position, and the heating roller 34 positioned at the angle θ=+105° and the heating roller 34 positioned at the angle θ=−255° were in the same angular position. Defects of toner images at the outlet of the rolling contact region represent sheet offsets or sheet jams.

The experiment was conducted under the following conditions:

The nipping width in the rolling contact region was set to 8 mm, and the pressing roller 30 applied a pressure P1 of 24 kgf to one side of the unfixed toner sheet S. The temperature of the fixing belt 36 trained around the fixing roller 28 was set to 160° C. The surface temperature of the pressing roller 30 was set to 140° C. The speed at which to feed the unfixed toner sheet S was set to 180 mm/sec. The pressing roller 30 was rotated in synchronism with the speed of 180 mm/sec. The toner used was an A color toner manufactured by Fuji Xerox. The sheet S used was plain paper having a weight of 64 g/m$^2$.

The experiment was made for nine angles θ of 90°, 105°, 120°, 150°, 180°, −150°, −120°, −105°, −90°.

The results of the experiment are given in Table 2 shown below.

TABLE 2

| | Copied on one side | | Copied on both sides | | |
|---|---|---|---|---|---|
| Angles | A | B | A | B | Evaluation |
| 90° | 3/5 | 0/5 | 5/5 | 0/5 | Not acceptable |
| 105° | 0/5 | 0/5 | 1/5 | 0/5 | Partly acceptable |
| 120° | 0/5 | 0/5 | 0/5 | 0/5 | Acceptable |
| 150° | 0/5 | 0/5 | 0/5 | 0/5 | Acceptable |
| ±180° | 0/5 | 0/5 | 0/5 | 0/5 | Acceptable |
| −150° | 0/5 | 0/5 | 0/5 | 0/5 | Acceptable |
| −120° | 0/5 | 0/5 | 0/5 | 0/5 | Acceptable |
| −105° | 0/5 | 2/5 | 0/5 | 3/5 | Not acceptable |
| −90° | 0/5 | 5/5 | 0/5 | 5/5 | Not acceptable |

A: The frequency of rubbed states of toner images at the inlet of the rolling contact region.
B: The frequency of defects of toner images at the outlet of the rolling contact region.

As can be seen from Table 2, when the angle θ is greater than 105° and smaller than −105°, i.e., when the angle θ is in a range from 105° to 255° as measured only counterclockwise, toner images were neither rubbed at the inlet of the rolling contact region nor defective at the outlet of the rolling contact region, indicating a good toner image fixing process. However, when the angle θ is equal or smaller than 105°, toner images were either rubbed at the inlet of the rolling contact region and/or defective at the outlet of the rolling contact region, indicating a poor toner image fixing process.

Temperature control for the heater 32

A process of controlling the temperature of the heater 32 of the toner image fixing apparatus 10 will be described below.

If settings for the temperatures of the fixing belt 36 on the fixing roller 28 and the heating roller 34 are represented by T1, T2, respectively, then the control circuit 86 shown in FIG. 4 controls the heater driver 88, i.e., turns on and off the heater driver 88, based on the detected signals from the first and second thermistors 80, 82, to control the amount of heat generated by the heater 32 so that the temperatures of the fixing belt 36 on the fixing roller 28 and the heating roller 34 will be equalized to the settings T1, T2, respectively.

First, when the toner image fixing apparatus 10 is in a normal standby mode, i.e., when the temperature of the fixing belt 36 on the fixing roller 28 is lower than the temperature setting T1, the control circuit 86 controls the amount of heat generated by the heater 32 through the heater driver 88 based on the temperature detected by the first thermistor 80, so that the temperature of the fixing belt 36 on the heating roller 34 will be equalized to the temperature setting T2.

When the fixing belt 36 is rotated in the normal standby mode, the fixing roller 28 and the pressing roller 30 are heated by the heat transferred by the fixing belt 36, and the temperatures of the fixing belt 36 on the fixing roller 28 and the heating roller 34 increase. When the temperature of the fixing belt 36 on the fixing roller 28 reaches the temperature setting T1, the control circuit 86 switches internal relays (not shown), and controls the amount of heat generated by the heater 32 through the heater driver 88 based on the temperature detected by the second thermistor 82, so that the temperature of the fixing belt 36 on the fixing roller 28 will be equalized to the temperature setting T1.

After the fixing belt 36 is stopped, the temperature of the fixing belt 36 on the fixing roller 28 gradually decreases below the temperature setting T1. The control circuit 86 switches the internal relays again, and controls the amount of heat generated by the heater 32 through the heater driver 88 based on the temperature detected by the first thermistor 82, so that the temperature of the fixing belt 36 on the heating roller 34 will be equalized to the temperature setting T2.

Figure 6:
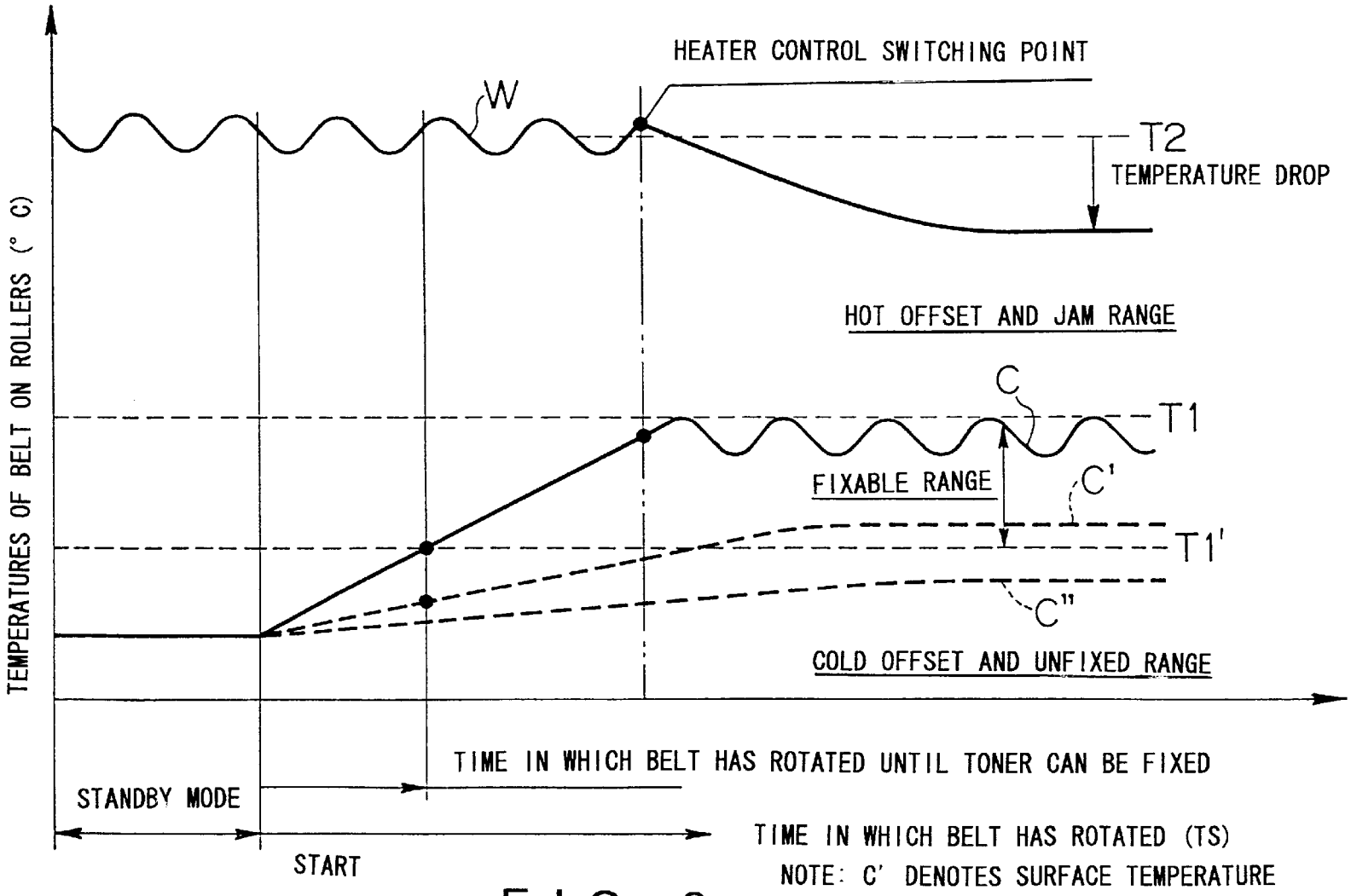
FIG. 6 is a diagram showing temperature characteristics of a fixing belt on the rollers plotted when a temperature control process is carried out by a control circuit of the toner image fixing apparatus shown in FIG. 1.

FIG. 6 shows temperature characteristics of the fixing belt 36 on the rollers 28, 34 plotted when the above temperature control process is carried out by the control circuit 88. In FIG. 6, the horizontal axis represents the period of time in which the fixing belt 36 has rotated, and the vertical axis represents the temperature of the fixing belt 36 on the rollers 28, 34. A solid-line wavy curve W represents the temperature of the fixing belt 36 on the heating roller 34, and a solid-line characteristic curve C represents the temperature of the fixing belt 36 on the fixing roller 28. After a standby period until the temperature of the fixing belt 36 on the fixing roller 28 increases up to the temperature setting T1, the temperature of the fixing belt 36 on the heating roller 34 is controlled so as to be equalized to the temperature setting T2. When the temperature of the fixing belt 36 on the fixing roller 28 reaches the temperature setting T1, the control circuit 86 switches the internal relays, and controls the amount of heat generated by the heater 32 through the heater driver 88, so that the temperature of the fixing belt 36 on the fixing roller 28 will be equalized to the temperature setting T1. Therefore, the temperature of the fixing belt 36 on the fixing roller 28 will not increase beyond the temperature setting T1, i.e., an upper limit temperature of a toner image fixing temperature range, and hence sheet offsets and sheet jams will not occur.

After the control circuit 86 has started to control the amount of heat generated by the heater 32 to equalize the temperature of the fixing belt 36 on the fixing roller 28 to the temperature setting T1, the temperature of the fixing belt 36 on the heating roller 34 gradually falls. However, since the temperature of the surface of the pressing roller 30 as indicated by a temperature curve C', and the temperature of a sheet preheating region (the guide plate 44 and its atmosphere) as indicated by a temperature curve C" increase to make up for the reduction in the temperature of the fixing belt 36 on the heating roller 34, the toner image fixing apparatus 10 maintains its toner image fixing capability.

Tests comparing the conventional temperature control process described above and the above temperature control process according to the present invention will be described below with reference to Table 3 below and FIG. 7.

TABLE 3

| | | Idling time (sec.) | | | | | |
|---|---|---|---|---|---|---|---|
| | | At start | 20 | 40 | 60 | 120 | 300 |
| A | Belt temp. on heating roller (° C.) | 160 | 156 | 157 | 158 | 158 | 158 |
| | Belt temp. on mixing roller (° C.) | 60 | 124 | 140 | 143 | 146 | 149 |
| | Occurrence of sheet jams | | 0/10 | 1/10 | 3/10 | 5/10 | 9/10 |
| | Occurrence of sheet offsets | | 0/10 | 0/10 | 1/10 | 3/10 | 5/10 |
| | Fixing capability | | Good | Good | Good | Good | Good |
| B | Belt temp. on heating roller (° C.) | 160 | 156 | 157 | 153 | 154 | 149 |
| | Belt temp. on fixing roller (° C.) | 60 | 124 | 135 | 136 | 136 | 138 |
| | Occurrence of sheet jams | | 0/10 | 0/10 | 0/10 | 0/10 | 0/10 |
| | Occurrence of sheet offsets | | 0/10 | 0/10 | 0/10 | 0/10 | 0/10 |
| | Fixing capability | | Good | Good | Good | Good | Good |

A: Conventional control process
B: Inventive control process

Table 3 shown above indicates the results of tests which were conducted to detect the temperatures of the fixing belt 36 on the heating roller 34 and the fixing roller 28 after elapse of certain idling times of the fixing belt 36 and also to determine sheet jams and off-sets and toner image fixing capability. Each of the numerators of numerical values representing sheet jams or offsets in Table 3 indicate the number of sheet jams or offsets that occurred per 10 tests.

The tests used a fixing belt comprising a polyimide layer having a thickness of 100 $\mu$m and a silicone rubber layer having a thickness of 100 $\mu$m, a fixing roller made of silicone sponge having a hardness of 30 HS and a thickness of 4 mm, and a pressing roller made of silicone sponge having a hardness of 40 HS and a thickness of 4 mm. The fixing belt was rotated at a linear velocity of 80 mm/sec., and the pressing roller applied a pressure of 14.6 kg on one side of sheets. The temperature setting T1 for the fixing roller ranged from 135° C. to 140° C., and the temperature setting T2 for the heating roller ranged from 155° C. to 160° C. Sheets of paper used for confirming sheet jams had a weight of 45 kg per 1,000 sheets, A4 size (52.3 g/m$^2$), and were coated with toner fully over their entire surface with no toner-free region at their leading edge. Sheets of paper used for confirming sheet offsets and toner image fixing capability had a weight of 55 kg per 1,000 sheets, A4 size (64 g/m$^2$), and were coated with toner fully over their entire surface with a toner-free region at their leading edge.

As can be understood from Table 3, according to the conventional control process, after the fixing belt 36 started to rotate, the temperature of the fixing belt 36 on the fixing roller 28 gradually increased. After elapse of 40 seconds after the fixing belt 36 started to rotate, the temperature of the fixing belt 36 on the fixing roller 28 exceeded the upper limit temperature (140° C.) of the toner image fixing temperature range. Though the toner image fixing capability suffers no problem, the number of sheet offsets and jams gradually increased. After elapse of 300 seconds after the fixing belt 36 started to rotate, almost all sheets suffered sheet jams, and 50% of all sheets suffered sheet offsets.

Figure 7:
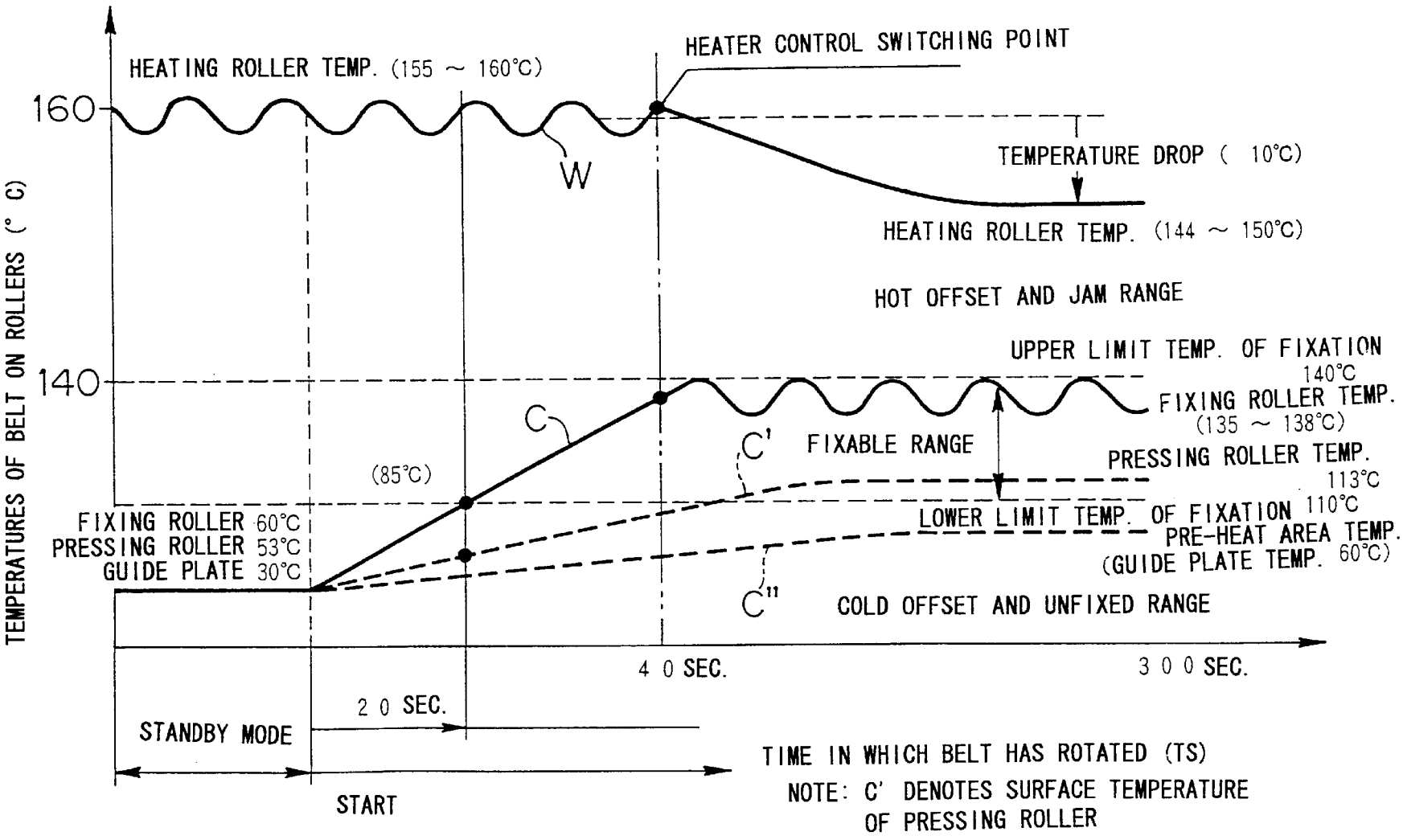
FIG. 7 is a diagram showing temperature characteristics of the fixing belt on the rollers plotted when the temperature control process is carried out in tests by the control circuit of the toner image fixing apparatus shown in FIG. 1.

The control process according to the present invention produced results as shown in Table 3 and FIG. 7.

In FIG. 7, a solid-line wavy curve W represents the temperature of the fixing belt 36 on the heating roller 34, and a solid-line characteristic curve C represents the temperature of the fixing belt 36 on the fixing roller 28.

After a standby period, until the temperature of the fixing belt 36 on the fixing roller 28 increased to the temperature setting of 135° C., the control circuit 86 controls the amount of heat generated by the heater 32 through the heater driver 88 so that the temperature of the fixing belt 36 on the heating roller 34 would fall in the temperature setting range from 155° C. to 160° C. Upon elapse of 40 seconds after the fixing belt 36 started to rotate, the temperature of the fixing belt 36 on the fixing roller 28 reached the temperature setting of 135° C., the control circuit 86 switches the internal relays, and controls the amount of heat generated by the heater 32 through the heater driver 88 so that the temperature of the fixing belt 36 on the fixing roller 28 would fall in the temperature setting range from 135° C. to 140° C. Subsequently, the temperature of the fixing belt 36 on the fixing roller 28 did not exceed the upper limit temperature of 140° C. Therefore, no sheet offsets and jams occurred.

After the amount of heat generated by the heater 32 was controlled to control the temperature of the fixing belt 36 on the fixing roller 28 to fall in the temperature setting range from 135° C. to 140° C., the temperature of the fixing belt 36 on the heating roller 34 gradually decreased and varied between 144° C. and 150° C. However, since the temperature of the surface of the pressing roller 30 as indicated by a temperature curve C', and the temperature of a sheet preheating region (the guide plate 44 and its atmosphere) as indicated by a temperature curve C" increased to make up for the reduction in the temperature of the fixing belt 36 on the heating roller 34, the toner image fixing capability of the toner image fixing apparatus 10 was not impaired.

Standby mode temperature control by the control circuit 86

In the standby mode, the control circuit 86 carries out a standby mode temperature control process for keeping the temperatures of the outer circumferential surfaces of the fixing roller 28 and the pressing roller 30 in a predetermined temperature range.

According to the standby mode temperature control process, if the control circuit 86 determines that the temperature of the pressing roller 30 is lower than a predetermined temperature range based on a detected signal from the third thermistor 84, the control circuit 86 controls the heater driver 88 to energize the heater 32, and also controls the actuating mechanism 52 to rotate the pressing roller 30 to rotate the fixing belt 36 for thereby heating the fixing roller 28 and the pressing roller 30 held in rolling contact with the fixing roller 28. The temperature range for the pressing roller 30 is established so as to be higher than the temperature thereof at the time it is cold and lower than the temperature setting T1.

If the control circuit 86 determines that the temperature of the pressing roller 30 is higher than the predetermined temperature range based on a detected signal from the third thermistor 84, the control circuit 86 controls the heater driver 88 to de-energize the heater 32, and continuously controls the actuating mechanism 52 to rotate the fixing belt 36 until a predetermined period of time elapses after the heater 32 is de-energized. After elapse of the predetermined period of time, the control circuit 86 controls the actuating mechanism 52 to stop the pressing roller 30 for thereby stopping the fixing belt 36.

When the standby mode is canceled, the control circuit 86 cancels the standby mode temperature control process for the heater driver 88 and the actuating mechanism 52.

Since the control circuit 86 effects the standby mode temperature control process, even when the standby mode continues for a long period of time, the fixation readiness time, i.e., the period of time required for the toner image fixing apparatus 10 to become ready for fixing toner images, subsequent to the standby mode can be shortened, so that the operator does not need to wait long before a fixing process begins.

In the above embodiment, the heating roller 34 is positioned substantially upwardly of the fixing roller 28, i.e., the heating roller 34 is angularly positioned with respect to the fixing roller 28 such that the angle formed between the line segment L interconnecting the center of the heating roller 34 and the center of the fixing roller 28 and the reference line B interconnecting the center of the fixing roller 28 and the center of the pressing roller 30 lies in a range from about 105° to about 255°. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Consequently, no matter how the unfixed toner sheet being fed is curled due to jumping or sagging on account of the speed difference between a speed difference between the toner image fixing apparatus 10 and a preceding toner image transferring apparatus, the unfixed toner image on the upper surface of the unfixed toner sheet is reliably prevented from touching the fixing belt 36, and can be led, without being disturbed, into the rolling contact region between the fixing roller 28 and the pressing roller 30, so that the toner image can reliably be fixed to the sheet by the fixing roller 28.

The fixing roller 28 comprises a resilient roller, and the pressing roller 30 comprises a roller harder than the fixing roller 28. Therefore, even if the fixing roller 28 and the pressing roller 30 are small in diameter, they provide a sufficiently large nipping width in a direction across their axes. As a consequence, the toner image fixing apparatus 10 may be relatively small in size, and sheets can be fed through toner image fixing apparatus 10 at high speed. The toner image fixing apparatus 10 is thus suitable for use in color printers.

Figure 9:
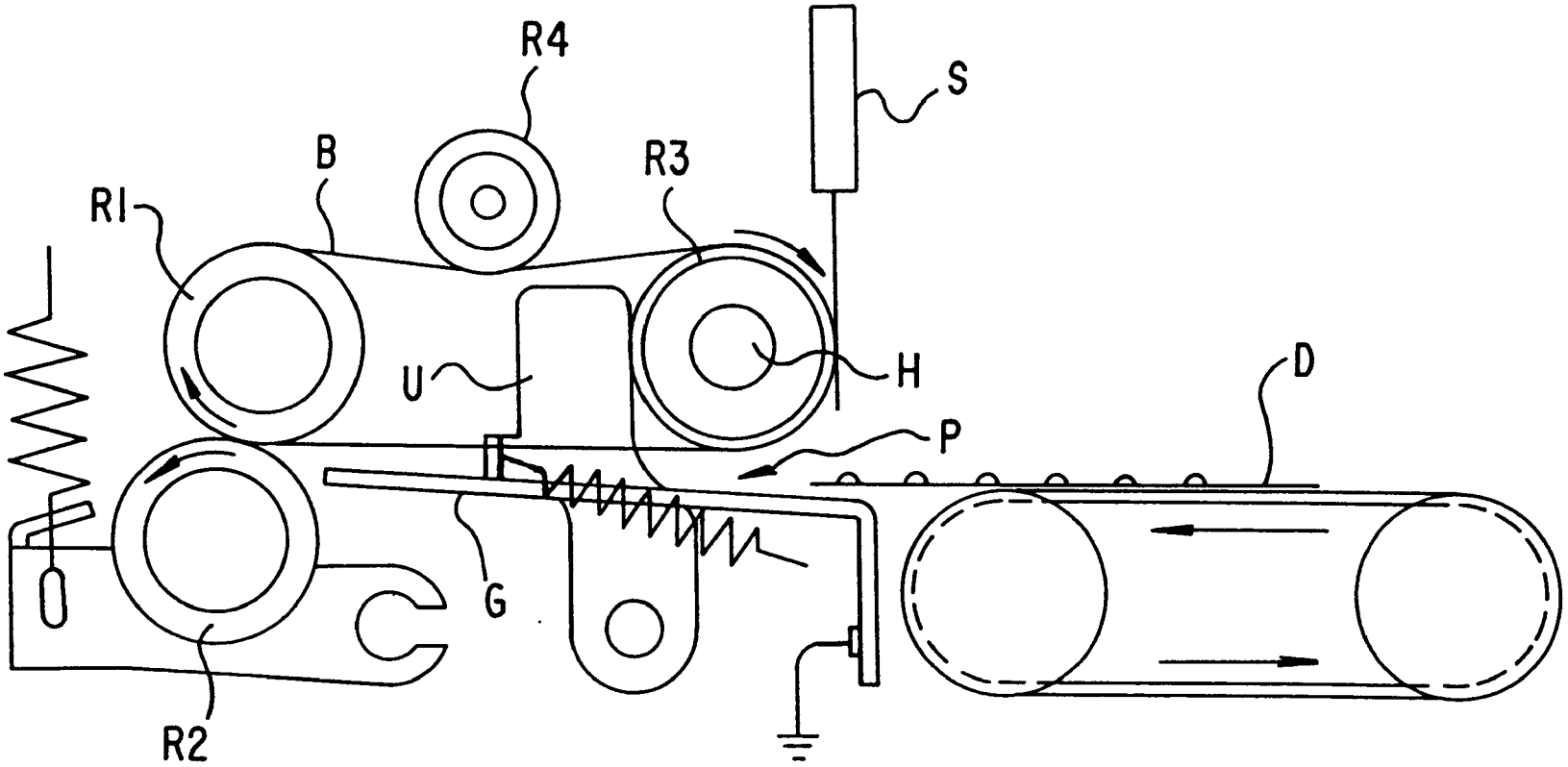
FIG.9 PRIOR ART
FIG. 9 is a sectional front elevational view of a conventional toner image fixing apparatus.
Figure 10:
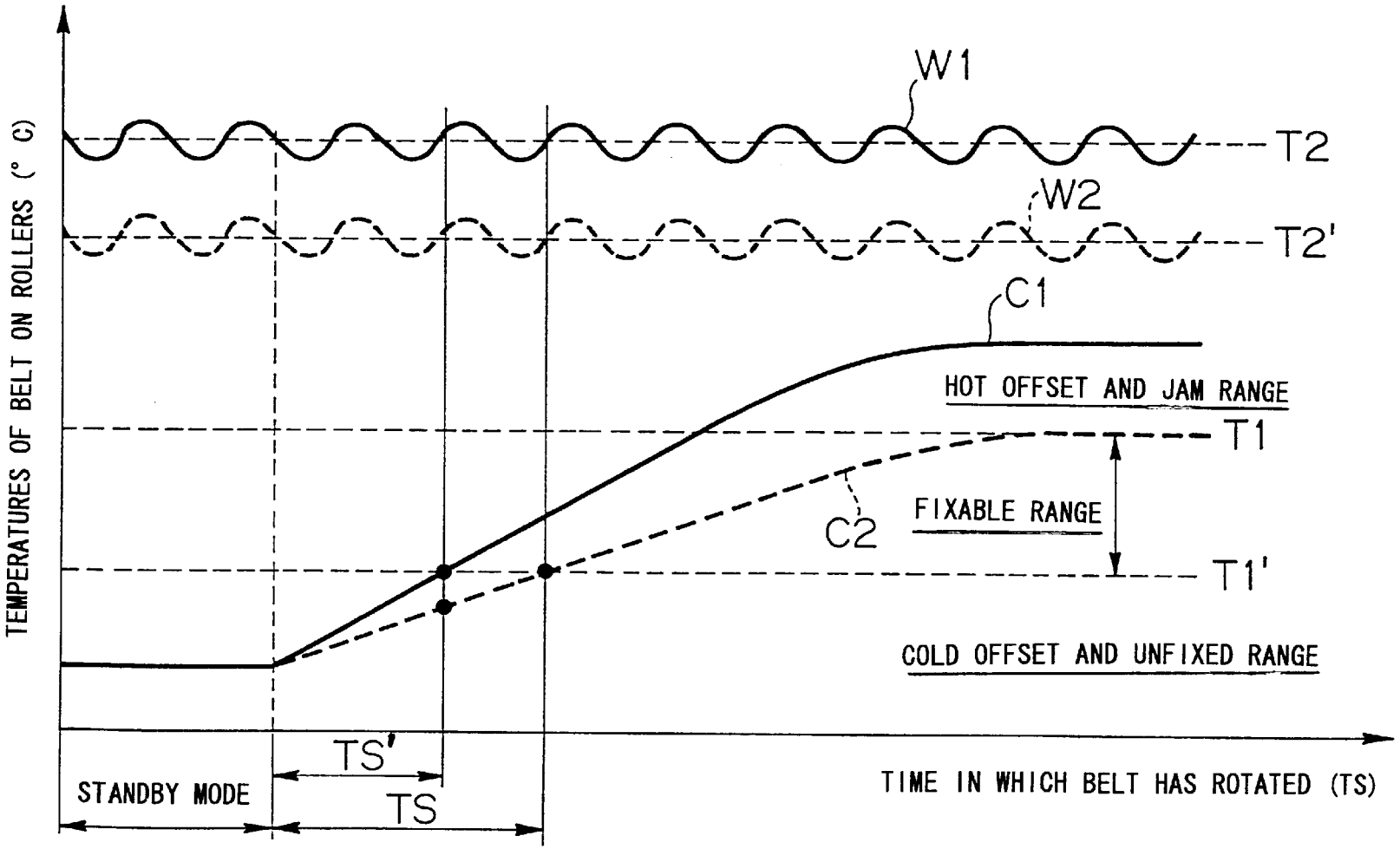
PRIOR ART FIG. 10
FIG. 10 is a diagram showing temperature characteristics of a fixing belt on rollers of the conventional toner image fixing apparatus shown in FIG. 9.

As described above, inasmuch as the fixing roller 28 positioned above the pressing roller 30 comprises a resilient roller and the pressing roller 30 comprises a roller harder than the fixing roller 28, the fixing roller 28 provides an upwardly concave surface in the nipping region, unlike the conventional structure shown in FIG. 9. The upwardly concave nipping region provided by the fixing roller 28 produces forces tending to separate a sheet carrying a fixed toner image from the fixing belt 36. Even though the toner is carried on the surface of the sheet held in contact with the fixing belt 36, because the sheet can easily be separated from the fixing belt 36 due to the upwardly concave nipping region, the amount of oil applied to the fixing belt 36 by the oil applying roller 38 for preventing sheet offsets and jams may be relatively small. Actually, the upwardly concave nipping region provided by the fixing roller 28 is effective to avoid sheet offsets and jams between the fixing roller 28 and the pressing roller 30 even without the application of oil to the fixing belt 36 by the oil applying roller 38.

Furthermore, the fixing belt 36 is made of a material having a small heat capacity, trained around the heating roller 34 at a large contact angle, and held in intimate contact with the heating roller 34. As a result, even when sheets are passed at a high speed, i.e., even when a large number of sheets are passed in a unit time, through the nipping region, the temperature necessary to fix toner images to the sheets can reliably be maintained in the rolling contact region between the fixing roller 28 and the pressing roller 30.

In the embodiment, the resilient fixing roller 28 does not house any heater, but the heating roller 34 spaced from the fixing roller 28 houses the heater 32 therein. Thus, it is possible to sufficiently increase the thickness of the roller sleeve 28B that is made of a heat-resistant resilient material. Consequently, the nipping width in the rolling contact region can be sufficiently large while at the same time the fixing roller 28 may be relatively small in diameter.

In addition, the one-way clutch 60 disposed between the first driven gear 58 and the fixing roller 28 allows the pressing roller 30, rather than the fixing roller 28, as a primary drive roller for establishing a speed at which the unfixed toner sheet is fed through the nipping region. Therefore, even when the fixing roller 28 is heated in the fixing process and thermally expanded to increase its diameter, since the speed at which the unfixed toner sheet is fed through the nipping region is not established by the fixing roller 28, it is not varied by the thermal expansion of the fixing roller 28, but is maintained at a constant level. Consequently, the fixing belt 36 is maintained at a constant linear velocity to prevent toner images from being displaced or rubbed.

Modifications

The toner image fixing apparatus 10 has been described as being used in an electrophotographic copying system. However, the principles of the present invention are not limited to such an application, but are also applicable to other electronic image forming systems including an electronic facsimile machine, an electronic printer, etc.

In the above embodiment, the unfixed toner sheet is introduced laterally into the toner image fixing apparatus 10. However, the unfixed toner sheet may be introduced vertically, e.g., upwardly, into the toner image fixing apparatus 10. In such a modification, the pressing roller 30 is disposed laterally of the fixing roller 28, and the heating roller 34 is disposed on one side of the fixing roller 28 which is opposite to the pressing roller 30.

In the above embodiment, the third thermistor 84 is provided to detect the temperature of the outer circumferential surface of the pressing roller 30. However, the third thermistor 84 may be dispensed with.

Figure 8:
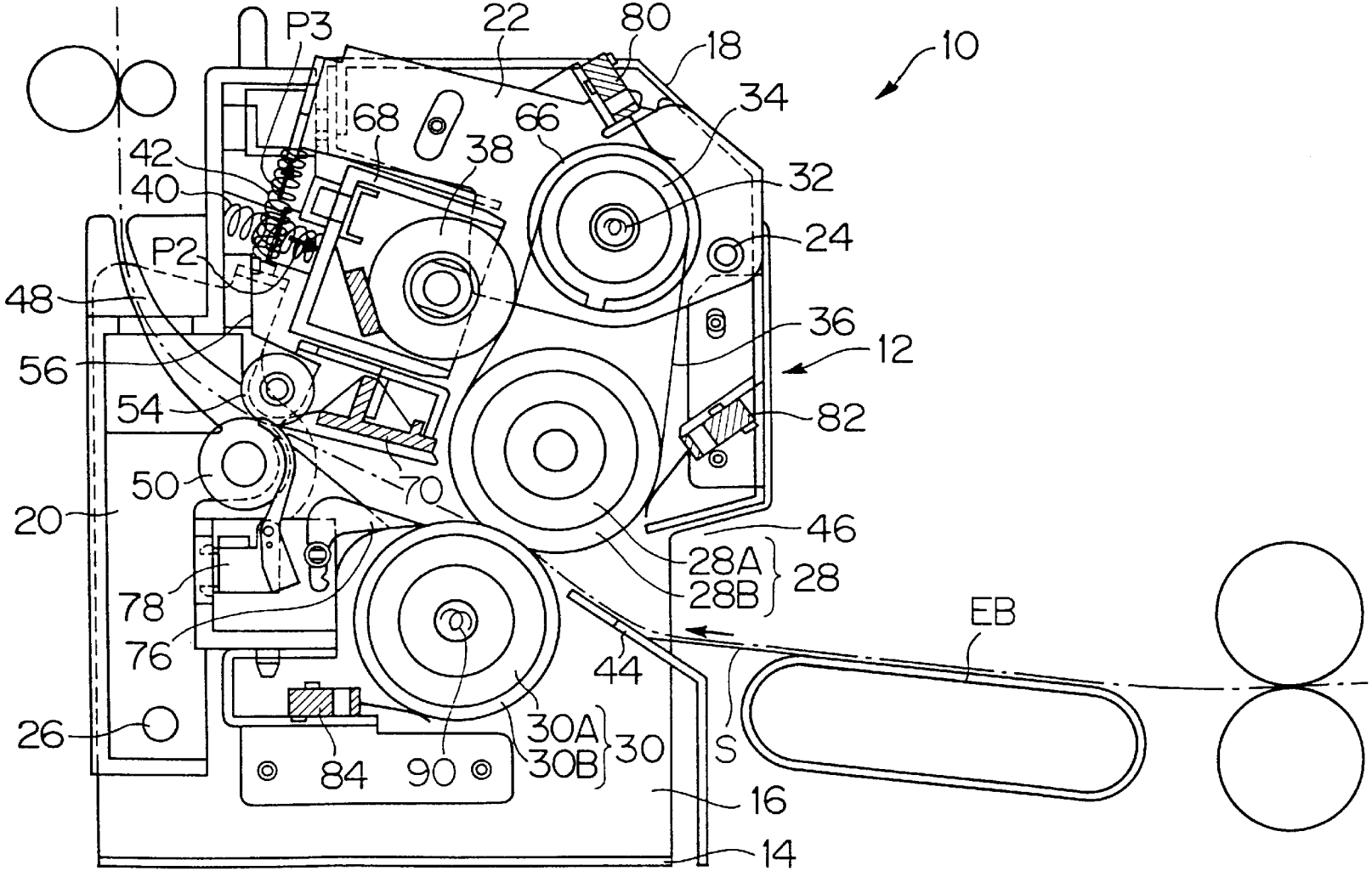
FIG. 8 is a sectional front elevational view of a toner image fixing apparatus according to a modification of the present invention.

In the above embodiment, the heater 32 is disposed in the heating roller 34. FIG. 8 shows a modification in which a heater 90 is also disposed in the pressing roller 30. In the modification shown in FIG. 8, the third thermistor 84 is necessarily employed to detect the temperature of the outer circumferential surface of the pressing roller 30. The amount of heat generated by the heater 90 may be controlled in the same manner as the heater 32 in the heating roller 34.

In the above embodiment, the temperatures of the heating belt 36 on the fixing roller 28 and the heating roller 34 are detected for the control of the heater 32. However, the temperatures of the surfaces of these rollers 28, 34 may be directly detected for controlling the heater 32 and also controlling the heater 90 in the modification shown in FIG. 8.

In the above embodiment, the control circuit 86 carries out the standby mode temperature control process according to a closed control loop (feedback control loop) based on the detected signal from the third thermistor 84. However, the control circuit 86 may have a counter for measuring a period of time that has elapsed from the start of the standby mode, and may control the heater driver 88 to energize the heater 32 and also control the actuating mechanism 52 to rotate the pressing roller 30 at a first time interval measured by the counter from the start of the standby mode, for thereby rotating the fixing belt 36 to heat the fixing roller 28 and the pressing roller 30 held in rolling contact therewith.

The control circuit 86 may also control the heater driver 88 to energize the heater for a second time interval and further control the actuating mechanism 52 to rotate the pressing roller 30 for a third time interval longer than the second time interval, so that the fixing belt 36 can be rotated to heat the fixing roller 28 and the pressing roller 30 held in rolling contact therewith.

When the control circuit 86 carries out the standby mode temperature control process according to an open control loop based on a detected signal from the above counter, the standby mode temperature control process can be performed without the use of the third thermistor 84. As a result, the cost of the toner image fixing apparatus 10 may be reduced.

Although certain preferred embodiments of the present invention have been shown and described in detail, it should be understood that various changes and modifications may be made therein without departing from the scope of the appended claims.

What is claimed is:

1. A toner image fixing apparatus comprising:

a fixing roller rotatable about a fixed axis;

a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller;

a heating roller disposed on one side of said fixing roller opposite to said pressing roller, said heating roller having a heat source disposed therein for heating said heating roller;

an endless heat transfer belt trained around said heating roller and said fixing roller for transferring heat from said heat source to heat the unfixed toner image on said sheet when said sheet passes through said rolling contact region; and a standby mode temperature control device for maintaining temperatures of said fixing roller and said pressing roller in a predetermined temperature range in a standby mode.

2. The toner image fixing apparatus according to claim 1 which further comprises;

an actuating device for rotating at least said pressing roller; and a heating control device for controlling said heat source.

3. The toner image fixing apparatus according to claim 2, which further comprises:

a detecting device for detecting the temperature of said pressing roller, and wherein said standby mode temperature control device includes means for controlling said heat control device to energize said heat source and also controlling said actuating device to rotate said pressing roller to rotate said endless heat transfer belt for thereby heating said fixing roller and said pressing roller held in rolling contact therewith, if the temperature of said pressing roller is determined as being lower than said predetermined temperature range based on the temperature of said pressing roller detected by said detecting device.

4. The toner image fixing apparatus according to claim 3, wherein said standby mode temperature control device includes means for controlling said heating control device to de-energize said heat source and also controlling said actuating device to stop said pressing roller a predetermined period of time after said heat source is de-energized, if the temperature of said pressing roller is determined as being higher than said predetermined temperature range based on the temperature of said pressing roller detected by said detecting device.

5. The toner image fixing apparatus according to claim 4, wherein said standby mode temperature control device includes means for stopping controlling said heating control device and said actuating device when said standby mode is cancelled.

6. The toner image fixing apparatus according to claim 2, which further comprises:

a counting device for measuring a period of time that has elapsed from the start of the standby mode, and wherein said standby mode temperature control device includes means for controlling said heating control device to energize said heating source and also controlling said actuating device to rotate said pressing roller at a first time interval measured by said counting device from the start of the standby mode, for thereby heating said fixing belt and said pressing roller held in rolling contact therewith.

7. The toner image fixing apparatus according to claim 6, wherein said standby mode temperature control device includes means for controlling said heating control device to energize said heat source for a second time interval and further controlling said actuating device to rotate said pressing roller for a third time interval.

8. The toner image fixing apparatus according to claim 7, wherein said third time interval is longer than said second time interval.

9. The toner image fixing apparatus according to claim 6, wherein said standby mode temperature control device includes means for stopping controlling said heating control device and said actuating device when said standby mode is cancelled.

10. The toner image fixing apparatus according to claim 2, wherein said predetermined temperature range is lower than a temperature at which the unfixed toner image is fixed to said sheet.

* * * * *